US008696108B2

(12) United States Patent
Sakurai et al.

(10) Patent No.: US 8,696,108 B2
(45) Date of Patent: Apr. 15, 2014

(54) PRINTING PRESS

(75) Inventors: Hideaki Sakurai, Hiroshima-ken (JP); Shoichi Aoki, Hiroshima-ken (JP); Makoto Kaji, Mihara (JP); Norifumi Tasaka, Mihara (JP)

(73) Assignee: Mitsubishi Heavy Industries Printing & Packaging Machinery, Ltd., Hiroshima (JP)

( * ) Notice: Subject to any disclaimer, the term of this patent is extended or adjusted under 35 U.S.C. 154(b) by 125 days.

(21) Appl. No.: 13/322,230

(22) PCT Filed: May 21, 2010

(86) PCT No.: PCT/JP2010/058632

§ 371 (c)(1),
(2), (4) Date: Nov. 23, 2011

(87) PCT Pub. No.: WO2010/137527

PCT Pub. Date: Dec. 2, 2010

(65) Prior Publication Data

US 2012/0069117 A1 Mar. 22, 2012

(30) Foreign Application Priority Data

May 26, 2009 (JP) ..... 2009-126642

(51) Int. Cl.
*B41J 2/01* (2006.01)

(52) U.S. Cl.
USPC ..... 347/104; 347/101

(58) Field of Classification Search
USPC ..... 347/104, 101; 101/232; 400/611, 642
IPC ..... B41J 2/01
See application file for complete search history.

(56) References Cited

U.S. PATENT DOCUMENTS 5,906,156 A 5/1999 Shibuya et al.
2002/0035939 A1 * 3/2002 Endo et al. ..... 101/480

(Continued)

FOREIGN PATENT DOCUMENTS

JP 10-286939 A 10/1998
JP 2946201 B2 9/1999

(Continued)

OTHER PUBLICATIONS

International Search Report for PCT/JP2010/058632 mailed Sep. 7, 2010.
Decision of a Patent Grant issued in Japanese application No. 2009-126642 dated May 14, 2013.

*Primary Examiner* — Manish S Shah
*Assistant Examiner* — Roger W Pisha, II
(74) *Attorney, Agent, or Firm* — Lowe Hauptman & Ham, LLP

(57) ABSTRACT

In a printing press, it is configured such that a newspaper web offset printing press is composed by a feeder device, a printing device, a guiding device, a turn bar device, and a folding unit; as a guiding device, there are provided an upstream side guide roller and a downstream side guide roller which are disposed with a predetermined interval along a transportation direction of a web for guiding transportation of the web; and there is disposed an ink-jet printer for performing digital printing on the web guided between the guide rollers. By setting diameters of the upstream side guide roller and the downstream side guide roller to different values, vibration of the print medium which is transported while being guided by the guide rollers is suppressed, and the print quality is thereby improved.

5 Claims, 3 Drawing Sheets

(56) References Cited

U.S. PATENT DOCUMENTS

| | | | | |
|---|---|---|---|---|
| 2003/0164101 | A1* | 9/2003 | Dagher | 101/217 |
| 2005/0224551 | A1* | 10/2005 | Hein et al. | 226/190 |
| 2006/0162595 | A1* | 7/2006 | Herbert | 101/228 |
| 2006/0216414 | A1* | 9/2006 | Sakamoto | 427/162 |
| 2007/0240592 | A1 | 10/2007 | Ronecker et al. | |
| 2008/0001338 | A1* | 1/2008 | Kotani | 270/37 |
| 2008/0271622 | A1* | 11/2008 | Ronecker et al. | 101/228 |
| 2009/0103965 | A1* | 4/2009 | Ronecker et al. | 400/613 |
| 2010/0229747 | A1* | 9/2010 | Ballreich et al. | 101/477 |

FOREIGN PATENT DOCUMENTS

| | | | |
|---|---|---|---|
| JP | 2002-361833 | A | 12/2002 |
| JP | 2003-154711 | A | 5/2003 |
| JP | 2005-059458 | A | 3/2005 |
| JP | 2007-253337 | A | 10/2007 |
| JP | 2007-276469 | A | 10/2007 |

* cited by examiner

PRINTING PRESS

RELATED APPLICATIONS

The present application is a National Phase of International Application Number PCT/JP2010/058632, filed May 21, 2010 and claims priority from, Japanese Application Number 2009-126642, filed May 26, 2009.

FIELD

The present invention relates to a printing press including processing devices in which appropriate processes are performed by various processing devices with respect to a print medium transported while being guided by a guiding device.

BACKGROUND

For example, newspapers are printed by a web offset printing press. The newspaper web offset printing press is configured by a plurality of feeder devices, a plurality of printing units, a turn bar device, and a folding unit. Therefore, when webs are fed to the printing units from the respective feeder devices, printing is performed on the webs. Then, after traveling routes of the plurality of webs are changed by the turn bar device, the webs are overlapped on one another in a predetermined order. Thereafter, the webs are folded lengthwise by the folding unit, cut widthwise to have a predetermined length, folded widthwise to form a folded quire, and then discharged as a newspaper.

A printing unit in such a newspaper web offset printing press requires a printing plate for printing articles or advertisements, and printing is performed with the printing plate being wound around a plate cylinder. Thus, in order to replace an article or advertisement with another, it is necessary to stop the printing unit and replace the printing plate with another. Thus, there is a problem such as lowering of the productivity of newspaper printing, and occurrence of waste paper.

In view of this, in a rotary press having an added printing device described in Patent Literature 1 below, for example, a paper feeding unit, a printing unit, and a folding unit are provided, and an ink-jet printing mechanism is also provided in the printing unit. In an ink-jet printing device described in Patent Literature 2 below, a group of ink-jet heads is provided so as to face a printing paper transported by rolls in the anterior and posterior positions.

CITATION LIST

Patent Literature

Patent Literature 1: Japanese Patent No. 2946201
Patent Literature 2: Japanese Patent Application Laid-open No. 2007-253337

SUMMARY

Technical Problem

And now, in a case where printing is performed with respect to a traveling printing paper using an ink-jet head, the printing paper needs to be stably traveled in order to ensure a high print quality. However, as in a conventional printing press, a printing paper which is traveling while being guided by rolls in the anterior and posterior positions vibrates in a direction perpendicular to the plane of the paper since it receives the transmission of rotational displacement of the two rolls in the anterior and posterior positions. That is, the rotational displacement of a roll occurs due to imbalanced rotation and faltering of the roll resulting from a manufacturing error, a secular change, or the like, deflection of the roll resulting from a change in the tension of a printing paper, and the like. In this case, the rolls have the same shape in view of versatility. Thus, the printing paper which has received the displacement of the two rolls resonates at a predetermined resonance point, and the amplitude thereof is amplified, thereby making it difficult to obtain stable traveling thereof.

The present invention is to solve the aforementioned problem, and an object thereof is to provide a printing press which suppresses a vibration of a print medium which is transported while being guided by guide rollers, thereby improving the print quality.

According to an aspect of the present invention, a printing press includes: a printing unit that performs printing to a print medium having a strip shape; a guiding unit that transports the print medium printed by the printing unit while guiding the print medium; and a folding unit that cuts and folds the print medium transported by the guiding unit. The guiding unit includes an upstream side guide roller and a downstream side guide roller which are disposed with a predetermined interval along a transportation direction of the print medium for guiding transportation of the print medium, a processing device that performs a predetermined process to the print medium guided between the respective guide rollers is disposed so as to face a printing surface of the print medium, and diameters of the upstream side guide roller and the downstream side guide roller are set to different values.

Advantageously, in the printing press, the diameter of the upstream side guide roller and the diameter of the downstream side guide roller are set so that one is a non-integral multiple of the other.

Advantageously, in the printing press, at least one of the upstream side guide roller and the downstream side guide roller can be dragged by traveling of the print medium.

Advantageously, in the printing press, the upstream side guide roller and the downstream side guide roller are disposed on a downstream side of the printing unit and on an upstream side of a turn bar that changes a transportation route of the print medium.

Advantageously, in the printing press, the processing device is an ink jet printer that performs printing on the print medium.

Advantageously, in the printing press, the processing device is a print quality inspection device that inspects a print quality of the printing surface of the print medium.

Advantageous Effects of Invention

According to a printing press of the present invention, a printing unit, a guiding unit, and a folding unit are included. As the guiding unit, there are provided an upstream side guide roller and a downstream side guide roller for guiding transportation of a print medium. Further, a processing device for performing a predetermined process with respect to the print medium guided between the guide rollers is disposed, and diameters of the upstream side guide roller and the downstream side guide roller are set to different values. Therefore, even if the rotational displacement of the upstream side guide roller and the downstream side guide roller is transmitted to the print medium, natural frequencies thereof are different from each other due to the different diameters and a resonance is thus prevented from occurring, thereby suppressing the vibration of the printing medium and improving the print quality.

According to the printing press of the present invention, since the diameter of the upstream side guide roller and the diameter of the downstream side guide roller are set so that one is a non-integral multiple of the other, the resonant frequency due to the displacement of the upstream side guide roller and the resonant frequency due to the displacement of the downstream side guide roller differ from each other, thereby appropriately preventing a resonance from occurring.

According to the printing press of the present invention, at least one of the upstream side guide roller and the downstream side guide roller can be dragged by the traveling of a print medium. Therefore, even if at least one of the guide rollers is dragged by the print medium, it is possible to appropriately suppress a resonance of the upstream side guide roller and the downstream side guide roller since the diameters of the upstream side guide roller and the downstream side guide roller are different from each other.

According to the printing press of the present invention, the upstream side guide roller and the downstream side guide roller are disposed on a downstream side of the printing unit and on an upstream side of the turn bar for changing a transportation route of a print medium. Therefore, it is possible to stably guide the print medium traveling by itself by the upstream side guide roller and the downstream side guide roller, thereby performing a process by a processing device with high accuracy.

According to the printing press of the present invention, since the ink-jet printer that performs printing with respect to a print medium is provided as a processing device, it is possible to realize highly-accurate printing by the ink-jet printer with respect to a print medium which is being stably transported.

According to the printing press of the present invention, since the print quality inspection device that inspects the print quality of a printing surface of a print medium is provided as a processing device, it is possible to perform highly-accurate quality inspection by the print quality inspection device with respect to the print medium being stably transported.

DESCRIPTION OF EMBODIMENTS

Preferred embodiments of a printing press according to the present invention will be described in detail below with reference to the accompanying drawings. Note that the present invention is not limited to the embodiments.

First Embodiment

Figure 1:
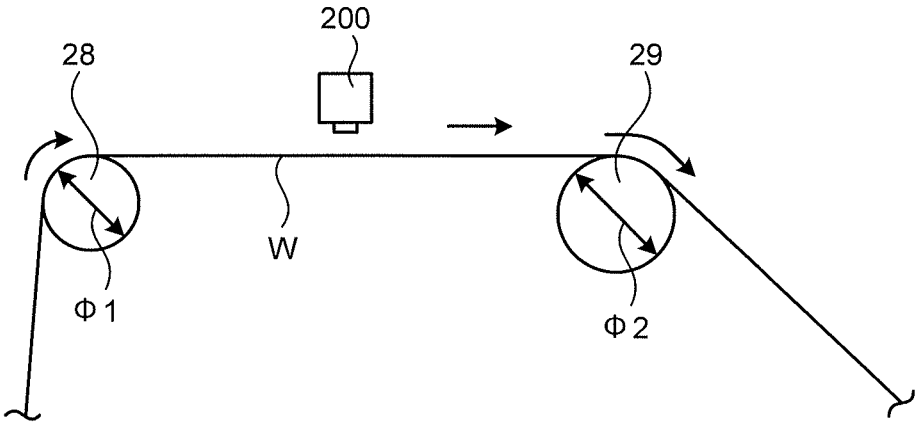
FIG. 1 is a schematic configuration view illustrating a guiding device applied to a printing press according to a first embodiment of the present invention.
Figure 2:
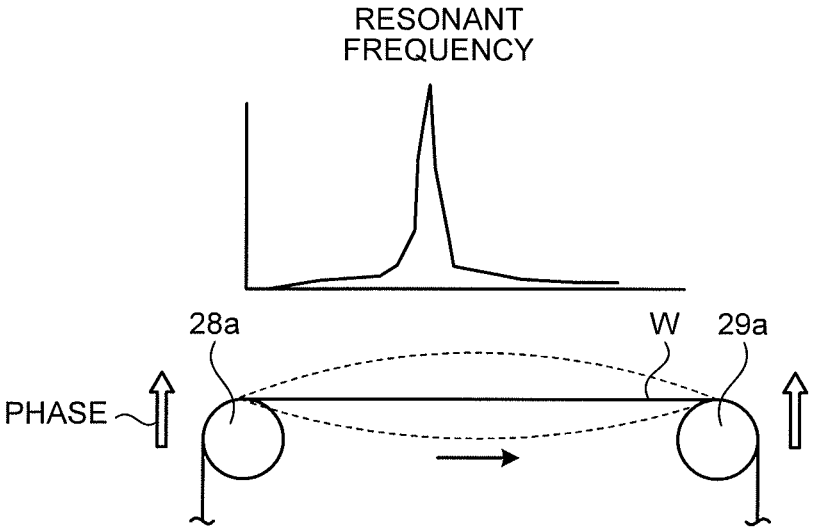
FIG. 2 is a schematic view illustrating a resonance state occurring when diameters of upstream side and downstream side guide rollers in the guiding device are the same.
Figure 3:
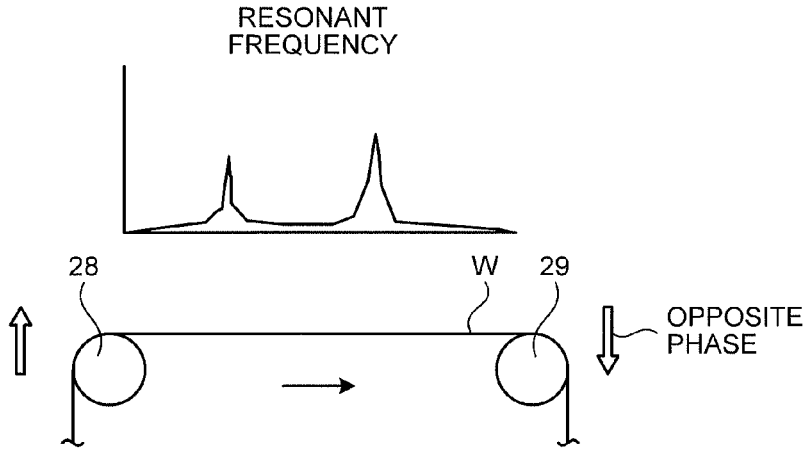
FIG. 3 is a schematic view illustrating a resonance state occurring when diameters of upstream side and downstream side guide rollers in the guiding device are different from each other.
Figure 4:
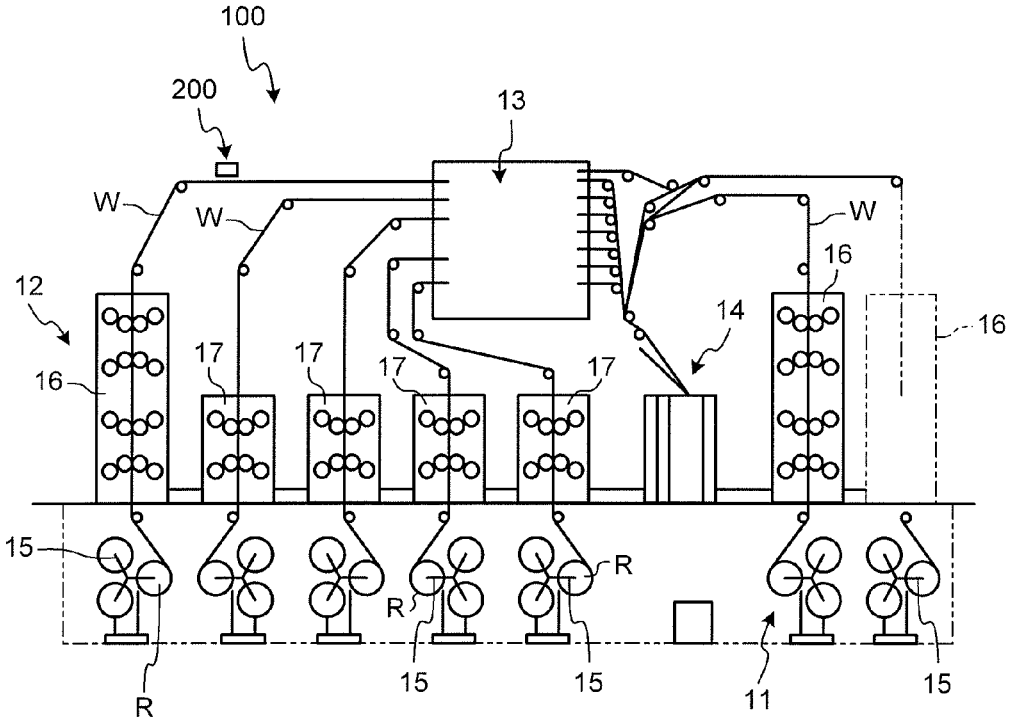
FIG. 4 is a schematic view illustrating an overall configuration of the printing press of the first embodiment.
Figure 5:
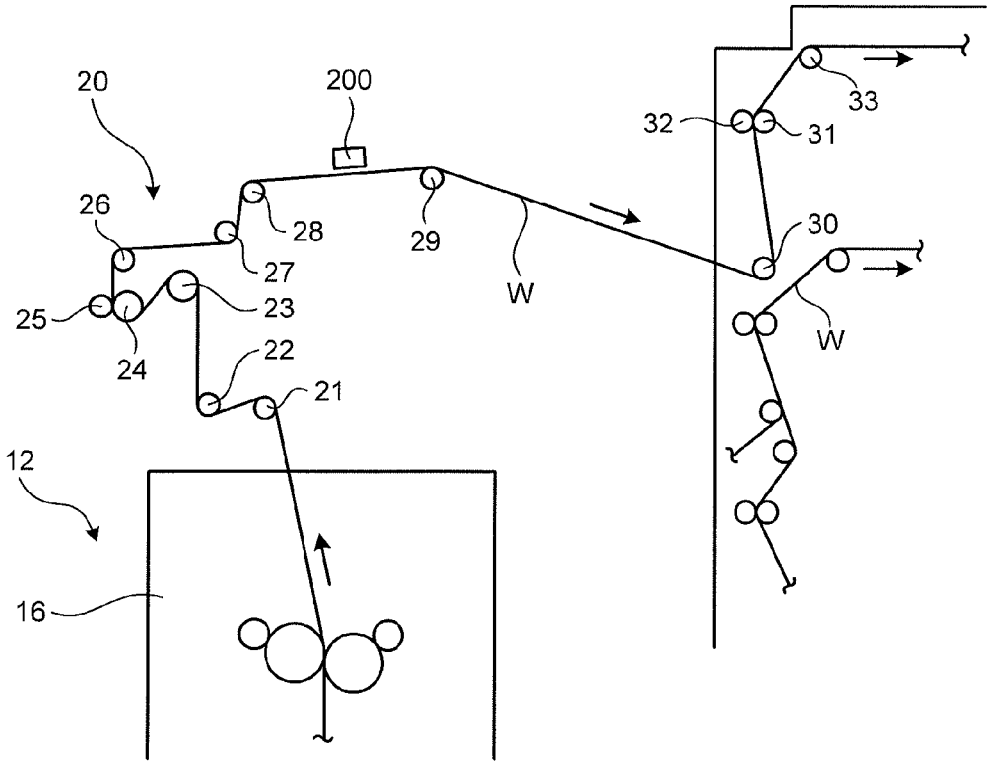
FIG. 5 is a schematic view illustrating a configuration from a printing unit to a turn bar device in the printing press according of the first embodiment.

FIG. 1 is a schematic configuration view illustrating a guiding device applied to a printing press according to a first embodiment of the present invention; FIG. 2 is a schematic view illustrating a resonance state occurring when diameters of upstream side and downstream side guide rollers in the guiding device are the same; FIG. 3 is a schematic view illustrating a resonance state occurring when diameters of upstream side and downstream side guide rollers in the guiding device are different from each other; FIG. 4 is a schematic view illustrating an overall configuration of the printing press of the first embodiment; and FIG. 5 is a schematic view illustrating a configuration from a printing unit to a turn bar device in the printing press of the first embodiment.

The printing press of the first embodiment is an application to a printing press for printing a newspaper as a print medium as shown in FIG. 4. That is, this printing press is configured by adding, to a newspaper web offset printing press 100 for printing predetermined information on a web (strip-shaped print medium) W by using a printing plate, an ink-jet printer (processing device) 200 as a digital printing press (on-demand printing press) for digitally printing specific information demanded by readers, or the like, on a specific position of the web W.

The newspaper web offset printing press 100 is configured by a feeder device (feeder unit) 11, a printing device (printing unit) 12, a turn bar device 13, and a folding unit 14. The feeder device 11 is provided with a plurality of holding arms 15 each holding three roll papers R obtained by winding the webs W in roll shapes. By turning each holding arm 15, the roll paper R can be turned to a paper feeding position. Moreover, the feeder device 11 is provided with a paper splicing device not shown in the figure. If a roll paper R being drawn out at the paper feeding position starts running out, a roll paper R at a standby position can be spliced with the roll paper R at the paper feeding position by the paper splicing device.

The printing device 12 is provided with multicolor printing units 16 each of which performs duplex four-color printing, and two-color printing units 17 each of which performs duplex two-color printing. The multicolor printing units 16 and the two-color printing units 17 can perform predetermined printing on the webs W fed from the feeder device 11. Note that while the printing device 12 is configured by the multicolor printing units 16 and the two-color printing units 17 in the present embodiment, the printing device 12 is not limited to this configuration. For example, various units such as a duplex single color printing unit for performing duplex single color printing, and a multicolor printing unit for performing one-sided four-color or two-color printing may be appropriately combined and used in accordance with a print.

Moreover, the turn bar device 13 is provided with a plurality of turn bars not shown in the figure. The turn bars can change traveling routes of the respective webs W sent out from the printing units 16 and 17 and overlap those webs W in a predetermined order. The folding unit 14 folds lengthwise the webs W transported from the turn bar device 13, cuts widthwise the webs W to have a predetermined length, further folds widthwise the cut webs W to form a desired folded quire, and then discharges the paper.

Therefore, first, if the webs W are fed from the feeder device 11 to the multicolor printing units 16 or the two-color printing units 17 forming the printing device 12, the printing units 16 or 17 perform four-color printing or two-color printing with respect to the webs W, respectively. Next, a plurality of webs W having been printed by the printing units 16 and 17 are changed their traveling routes and overlapped on one another in a predetermined order by the turn bar device 13. Then, the plurality of overlapped webs W are transported to the folding unit 14, folded lengthwise therein, then cut widthwise, further folded widthwise to form a desired folded quire, and discharged onto a paper discharge conveyor by an impeller.

On the other hand, the ink-jet printer 200 is disposed in the printing device 12 on a downstream side of a specific printing unit 16 in a transportation direction of the web W and on an upstream side of the turn bar device 13 or the folding unit 14 in a transportation direction of the web W. The present embodiment has a configuration such that the ink-jet printer 200 performs digital printing on a predetermined position of the web W which is transported while being guided by a guiding device 20 to be described later.

That is, in the guiding device 20, as shown in FIG. 5, guide rollers 21, 22, and 23, and also a drag roller (driving roller) 24 and a support roller 25 are disposed above the printing unit 16 in the printing device 12. Disposed above the drag roller 24 and the support roller 25 are guide rollers 26 and 27. Further, disposed to the side of the guide rollers 26 and 27 are an upstream side guide roller 28 and a downstream side guide roller 29 of the present invention. The upstream side guide roller 28 and the downstream side guide roller 29 are disposed with a predetermined interval along the transportation direction of the web W, and are for guiding the transportation of the web W. The ink-jet printer 200 that performs printing on the web W guided between the upstream side guide roller 28 and the downstream side guide roller 29 is disposed so as to face the printing surface of the web W.

A guide roller 30 is disposed to the side of the downstream side guide roller 29; a drag roller (driving roller) 31 and a slitter 32 are disposed above the guide roller 30; and further a guide roller 33 is disposed above the drag roller 31 and the slitter 32. Note that the turn bar device 13 described above is disposed to the side of the guide roller 33. Note that each of the guide rollers 21, 22, 23, 26, 27, 28, 29, 30, and 33 described above is undriven and can be dragged by the traveling web W.

Therefore, after being guided by the guide rollers 21, 22, and 23, the web W having been printed by the printing unit 16 travels by obtaining a driving force from the drag roller 24 and the support roller 25, and travels by being guided by the guide rollers 26 and 27, the upstream side guide roller 28, and the downstream side guide roller 29. At this time, the ink-jet printer 200 performs printing on a predetermined position of the web W which is traveling between the upstream side guide roller 28 and the downstream side guide roller 29. The web W receives a driving force from the drag roller 31 via the guide roller 30. After being cut by the slitter 32 along the traveling direction thereof, the web W is sent to the turn bar device 13 via the guide roller 33.

In the thus configured guiding device 20, as shown in FIG. 1, the web W is guided to the upper side of the upstream side guide roller 28 and guided to the upper side of the downstream side guide roller 29. The diameters of the upstream side guide roller 28 and the downstream side guide roller 29 are set to different values. In this case, the diameter of the upstream side guide roller 28 and the diameter of the downstream side guide roller 29 are set so that one is a non-integral multiple of the other in order to avoid a resonance. That is, assuming that the diameter of the upstream side guide roller 28 is $\phi 1$ and the diameter of the downstream side guide roller 29 is $\phi 2$, they are set to have a relationship of $\phi 1<\phi 2$ (alternatively, $\phi 1>\phi 2$). In this case, assuming that diameters of typical guide rollers 28 and 29 are such that $\phi$=90 to 130 mm and the relationship between the diameters of the guide rollers 28 and 29 is set to $\phi 1<\phi 2$, it is preferred that the diameter 41 of the upstream side guide roller 28 is set to 70 to 90% of the diameter $\phi 2$ of the downstream side guide roller 29. If a ratio between the diameters of the guide rollers 28 and 29 is set to be greater than this (less than 70%), the strength of each guide roller itself becomes insufficient. Conversely, if a ratio between the diameters of the guide rollers 28 and 29 is set to be smaller than this (greater than 90%), it is difficult to obtain an effect of dissimilating the diameters. Moreover, if the diameter of a guide roller whose diameter is greater than that of the other is set to be greater than 130 mm, a slip between the guide roller and the web W occurs due to the increase in weight. Specifically, they are set to $\phi 1$=100 mm and $\phi 2$=120 mm, for example.

As shown in FIG. 2, in a case where a conventional upstream side guide roller 28*a* and a conventional downstream side guide roller 29*a* whose diameters are the same are employed, the natural frequencies thereof are the same. Thus, the resonant frequencies thereof coincide with each other, resulting in a large amplitude. Therefore, the web W guided by the upstream side guide roller 28*a* and the downstream side guide roller 29*a* having the same diameters has a large vibration. On the other hand, as shown in FIG. 3, in a case where the upstream side guide roller 28 and the downstream side guide roller 29 of the present embodiment whose diameters are different from each other are employed, natural frequencies thereof are different from each other. Thus, resonant frequencies thereof do not coincide with each other, resulting in a small amplitude. Therefore, the vibration of the web W guided by the upstream side guide roller 28 and the downstream side guide roller 29 having different diameters becomes small.

As described above, the printing press of the first embodiment is configured such that the newspaper web offset printing press 100 is composed by the feeder device 11, the printing device 12, the guiding device 20, the turn bar device 13, and the folding unit 14; as the guiding device 20, there are provided the upstream side guide roller 28 and the downstream side guide roller 29 which are disposed with a predetermined interval along the transportation direction of the web W for guiding the transportation of the web W; and there is disposed the ink-jet printer 200 for performing digital printing with respect to the web W guided between the guide rollers 28 and 29. The diameters of the upstream side guide roller 28 and the downstream side guide roller 29 are set to different values.

Therefore, even if the rotational displacement of the upstream side guide roller 28 and the downstream side guide roller 29 is transmitted to the web W, since the diameters of the guide rollers 28 and 29 are different from each other, natural frequencies thereof differ from each other, thereby preventing a resonance and suppressing the vibration of the web W. As a result, it becomes possible to perform printing by the ink-jet printer 200 with high accuracy, thereby improving the print quality.

Moreover, according to the printing press of the first embodiment, the diameter of the upstream side guide roller 28 and the diameter of the downstream side guide roller 29 are set so that one is a non-integral multiple of the other. Therefore, the resonant frequency due to displacement of the upstream side guide roller 28 never coincides with the resonant frequency due to displacement of the downstream side guide roller 29, and it is therefore possible to prevent a resonance appropriately.

Moreover, according to the printing press of the first embodiment, the upstream side guide roller 28 and the downstream side guide roller 29 can be dragged by the traveling of the web W. Therefore, even if each guide roller 28 or 29 is dragged by the web W, it is possible to appropriately suppress a resonance of the upstream side guide roller 28 and the downstream side guide roller 29 since diameters of the upstream side guide roller 28 and the downstream side guide roller 29 are different from each other.

Moreover, according to the printing press of the first embodiment, the upstream side guide roller 28 and the downstream side guide roller 29 are disposed on a downstream side of the printing device 12 and on an upstream side of the turn bar device 13. Therefore, it is possible to stably guide the web W, which is traveling by itself, by the upstream side guide roller 28 and the downstream side guide roller 29, and it is possible to perform digital printing by the ink-jet printer 200 with high accuracy.

Moreover, according to the printing press of the first embodiment, the ink-jet printer 200 is provided between the upstream side guide roller 28 and the downstream side guide roller 29, and it is possible to perform highly-accurate printing by the ink-jet printer 200 with respect to the web W being stably transported.

Second Embodiment

Figure 6:
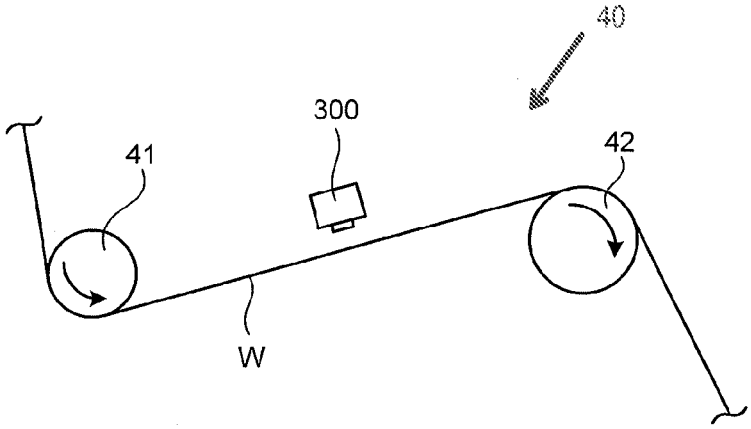
FIG. 6 is a schematic configuration view illustrating a guiding device applied to a printing press according to a second embodiment of the present invention.

FIG. 6 is a schematic configuration view illustrating a guiding device applied to a printing press according to a second embodiment of the present invention. Note that components having similar functions to those described in the above-described embodiment are denoted by like reference letters or numerals and a redundant description will be omitted.

According to the printing press of the second embodiment, as shown in FIG. 6, a guiding device 40 includes an upstream side guide roller 41 and a downstream side guide roller 42, and the web W is guided to the lower side of the upstream side guide roller 41 and guided to the upper side of the downstream side guide roller 42. The diameters of the upstream side guide roller 41 and the downstream side guide roller 42 are set to different values. In this case, the diameter of the upstream side guide roller 41 and the diameter of the downstream side guide roller 42 are set so that one is a non-integral multiple of the other.

A print quality inspection device 300 that inspects the print quality of a printing surface of the web W guided between the upstream side guide roller 41 and the downstream side guide roller 42 is disposed so as to face the printing surface of the web W. The print quality inspection device 300 is a CCD (Charge-Coupled Device) camera, for example, and is disposed over the entire region in the width direction of the web W. The print quality inspection device 300 outputs an image of the web W captured by the CCD camera to a control device. The control device detects a defect in the image, i.e., a stain, a blemish, splattered oil, splattered water, or the like, based on the captured image, measures the print density, distinguishes between a qualified paper and an unqualified paper, and removes the unqualified paper from a transportation line.

As described above, the printing press of the second embodiment is configured such that the newspaper web offset printing press 100 is composed by the feeder device 11, the printing device 12, the guiding device 20, the turn bar device 13, and the folding unit 14; as the guiding device 20, there are provided the upstream side guide roller 41 and the downstream side guide roller 42 which are disposed with a predetermined interval along the transportation direction of the web W for guiding the transportation of the web W; and there is disposed the print quality inspection device 300 that inspects the print quality of a printing surface of the web W guided between the guide rollers 41 and 42. The diameters of the upstream side guide roller 41 and the downstream side guide roller 42 are set to different values.

Therefore, even if the rotational displacement of the upstream side guide roller 41 and the downstream side guide roller 42 is transmitted to the web W, since the diameters of the guide rollers 41 and 42 are different from each other, natural frequencies thereof differ from each other, thereby preventing a resonance and suppressing the vibration of the web W. As a result, it becomes possible to perform print quality inspection with high accuracy by the print quality inspection device 300, thereby improving the print quality.

Moreover, according to the printing press of the second embodiment, the print quality inspection device 300 is provided between the upstream side guide roller 41 and the downstream side guide roller 42, thereby making it possible to perform highly-accurate inspection by the print quality inspection device 300 with respect to the web W being stably transported.

Note that although the ink-jet printer 200 or the print quality inspection device 300 as a processing device is disposed between the upstream side guide roller 28 or 41 and the downstream side guide roller 29 or 42 both of which are not driven in each of the embodiments described above, it is only necessary in the present invention that at least one of the upstream side guide roller and the downstream side guide roller is a guide roller which is not driven and can be dragged by the web W.

Although the upstream side guide roller 28 or 41 and the downstream side guide roller 29 or 42 are disposed on the downstream side of the printing device 12 and on the upstream side of the turn bar device 13 in each of the above-described embodiments, it is preferred that they are disposed on the downstream side of the printing device 12 and on the upstream side of the drag roller 31 and the slitter 32. That is, it is preferable to guide the web W which has already been printed and is running by itself without an overlap.

Moreover, while a print medium is the web W in each of the above-described embodiments, the print medium is not limited to this, and may be a resin sheet for printing. Also, while the printing press is the one obtained by adding the ink-jet printer 200 or the print quality inspection device 300 to the newspaper web offset printing press 100, the printing press is not limited to this configuration. It may be a commercial web offset printing press, or another processing device may be used.

INDUSTRIAL APPLICABILITY

The printing press according to the present invention is to improve the print quality by setting diameters of the upstream side guide roller and the downstream side guide roller guiding a print medium to different values so as to suppress a vibration of the print medium which is transported while being guided by the guide rollers, and can be applied to any printing press.

REFERENCE SIGNS LIST

11 feeder device (feeder unit)
12 printing device (printing unit)
13 turn bar device
14 folding unit
20 guiding device
28, 41 upstream side guide roller
29, 42 downstream side guide roller
100 newspaper web offset printing press
200 ink-jet printer (processing device)
300 print quality inspection device (processing device)

The invention claimed is:

1. A printing press comprising:

a printing unit for performing printing to a print medium having a strip shape;

a guiding unit for transporting the print medium printed by the printing unit while guiding the print medium, wherein the guiding unit includes an upstream side guide roller and a downstream side guide roller disposed with a predetermined interval along a transportation direction of the print medium configured to come into contact with the printing medium for guiding transportation of the print medium; and a processing device for performing a predetermined process to the print medium guided between the respective guide rollers is disposed so as to face a printing surface of the print medium, wherein diameters of the upstream side guide roller and the downstream side guide roller are set to different values for suppressing a vibration of the print medium, and wherein the diameter of the upstream side guide roller and the diameter of the downstream side guide roller are set so that one is not an integer multiple of the other.

2. The printing press according to claim 1, wherein at least one roller selected from the upstream side guide roller and the downstream side guide roller is configured to be dragged by traveling of the print medium.

3. The printing press according to claim 1, wherein the upstream side guide roller and the downstream side guide roller are disposed on a downstream side of the printing unit and on an upstream side of a turn bar for changing a transportation route of the print medium.

4. The printing press according to claim 1, wherein the processing device is an ink jet printer for performing printing on the print medium.

5. The printing press according to claim 1, wherein the processing device is a print quality inspection device for inspecting a print quality of the printing surface of the print medium.

* * * * *